United States Patent [19]

Kado et al.

[11] 4,078,919

[45] Mar. 14, 1978

[54] FERRITIC STAINLESS STEEL HAVING EXCELLENT WORKABILITY AND HIGH TOUGHNESS

[75] Inventors: Satoshi Kado; Taketomo Yamazaki, both of Fujisawa; Mikio Yamanaka, Machida; Katsuhiko Yabe; Kotaro Yoshida, both of Sagamihara, all of Japan

[73] Assignee: Nippon Steel Corporation, Tokyo, Japan

[21] Appl. No.: 692,927

[22] Filed: Jun. 4, 1976

Related U.S. Application Data

[63] Continuation-in-part of Ser. No. 651,818, Jan. 23, 1976, abandoned, which is a continuation of Ser. No. 524,265, Nov. 15, 1974, abandoned.

[30] Foreign Application Priority Data

Nov. 21, 1973 Japan ..... 48-130935

[51] Int. Cl.[2] ..... C22C 38/06; C22C 38/26; C22C 38/28

[52] U.S. Cl. ..... 75/124; 75/126 B; 75/126 D; 75/126 F

[58] Field of Search ..... 75/126 B, 126D, 126 F, 75/124; 148/37; 428/683

[56] References Cited

U.S. PATENT DOCUMENTS

| | | | |
|---|---|---|---|
| 2,183,715 | 12/1939 | Franks | 75/126 F |
| 2,597,173 | 5/1952 | Patterson | 75/126 D |
| 3,250,611 | 5/1966 | Lula | 148/37 |
| 3,499,802 | 3/1970 | Lagneborg | 148/37 |
| 3,607,246 | 9/1971 | Kalita | 75/126 D |
| 3,713,812 | 1/1973 | Brickner et al. | 75/126 F |
| 3,778,316 | 12/1973 | Pinnow et al. | 75/126 D |
| 3,832,244 | 8/1974 | Pinnow et al. | 148/37 |
| 3,847,600 | 11/1974 | Mimino et al. | 75/126 F |
| 3,890,143 | 6/1975 | Skoglund et al. | 75/126 D |

*Primary Examiner*—Arthur J. Steiner
*Attorney, Agent, or Firm*—Toren, McGeady and Stanger

[57] ABSTRACT

A ferritic stainless steel having high toughness both in the weld zone and the base metal comprising:

$C \leqq 0.05\%$ $Si \leqq 0.7\%$ $1.0 < Mn < 2.5\%$ $Cr = 10\% - 19\%$ (exclusive)

$Ti = 5 \times C\% - 0.5\%$ $N \leqq 0.03\%$ $Al \leqq 0.5\%$

Balance: Fe and unavoidable impurities.

4 Claims, 17 Drawing Figures

Effects by Effective Ti and Mn
on Toughness of Weld Zone

TIG Welding: t = 3.8 mm, 220A-14V-20 cm/min
Impact Test Piece: t = 2mm, 2 m/m Vnotch

PHOTO 1 INTERGRANULAR PRECIPITATES OF SPECIMENS

SPECIMEN: C = 0.01%, Mn = 0.15 %, Cr = 16.7 %, Ti = 0.33 % PAGE 16, TABLE 2. D

FC-2

FC-1

A-C

100 μ

SPECIMEN: C = 0.01 %, Mn = 1.4 %, Cr = 16.8 %, Ti = 0.32 % PAGE 16, TABLE 2. J

FC-2

FC-1

A-C

100 μ

ELECTRON-MICROSCOPE OF INTERGRANULAR PRECIPITATES (X 4000) 5μ (X 9000) 5μ

SPECIMEN D

SPECIMEN S

SPECIMEN Y

SPECIMEN J

FERRITIC STAINLESS STEEL HAVING EXCELLENT WORKABILITY AND HIGH TOUGHNESS

CROSS REFERENCES TO RELATED APPLICATIONS

This application is a Continuation-in-Part of copending application Ser. No. 651,818, filed on Jan. 23, 1976, which, in turn, is a continuation of application Serial No. 524,265, filed Nov. 15, 1974 both prior applications being abandoned.

BACKGROUND OF THE INVENTION

1. Field of the Invention

The present invention relates to a ferritic stainless steel having remarkably high toughness both in the base metal and the weld zone. Particularly, the steel of the present invention possesses excellent low temperature toughness and high workability.

2. Description of the Prior Art

As is well known, a ferritic stainless steel has lower elongation and impact strength as compared with an austenitic stainless steel, and this tendency increases as the chromium content increases. For example, when they are compared in respect of the transition temperature (vTrs) of impact value, a commonly used 12 Cr ferritic stainless steel (AISI 405) shows −10° C, while another commonly used 17 Cr ferritic stainless steel (AISI 430) shows about 20° C. Also, when the chromium content is higher, the 475° C embrittlement, the $\sigma$ embrittlement and the high temperature embrittlement are caused. These embrittlements are practically negligible if the chromium content is at a lower level as seen in the 405 and 430 grades, but their effects are remarkably worse in the case of higher Cr grades, such as, a 25 Cr stainless steel (AISI 446).

The high temperature embrittlement is caused by excessive grain growth as the result of dissolution of Cr carbides ($Cr_{23}C_6$) at high temperatures (1150° C or higher) into the steel matrix to form a single high chromium ferrite phase. This phenomenon is often seen even in the case of 430 grade steels in the welding heat-affected zone and deposited metal zone which were heated to 1150° C or higher. In fact, the $Cr_{23}C_6$ that precipitates in the grain boundaries in the case of a 430 steel is in the form of elongated strips which cause decreasing low temperature toughness and weld cracking.

The toughness of the weld zone can be mostly recovered by annealing between 730 and 790° C, but in the case of a steel in which the grains have grown excessively coarse, the recovery is small. For this reason, in common practice, the heat input is maintained as low as possible so as to restrict the excessive grain growth.

Ordinarily, in order to maintain the toughness of the weld zone of a ferritic stainless steel, it is necessary to prevent the growth of ferrite grains and at the same time to use a steel material with a chromium content maintained as low as possible for suppressing the high temperature embrittlement. However, use of the steel material with a lowered chromium content induces martensitization of the steel due to the formation of austenite, and depending on the carbon content, it inevitably brings forth hardening of the steel due to martensite. Therefore, various means have been tried, such as, the addition of Ti, Nb, etc., to overcome this problem. But in the case of a stainless steel with a higher chromium content than that of AISI 430, the steel has a greater tendency to form a single ferrite phase when Ti is added because Ti fixes the carbon, although the addition is effective for stabilizing the carbon, so that it is impossible to prevent the grain growth and thus the steel is susceptible to embrittlement.

As shown in Table 1, the impact value of AISI 430 steel is about 6 kg-m/cm² at room temperature (25° C) while the impact value in a weld zone of the same steel is very low, such as 0.6 kg-m/cm². Whereas, the 430 steel with the addition of Ti for the above purpose possesses an impact value of 16 kg-m/cm² at room temperature and its weld zone shows an impact value of 17.8 kg-m/cm². Thus, a remarkable improvement of toughness both in the base metal and the weld zone is obtained but almost no improvement with respect to the transition temperature is realized, namely +7° C in the weld zone and +15° C in the weld zone. Particularly, at a low temperature, e.g., lower than −20° C, this steel possesses an impact value of 1 kg-m/cm² in the base metal and 0.5 kg-m/cm² in the weld zone and thus almost no improvement of toughness is obtained.

TABLE 1

Results of V-Charpy Test of Ferritic Stainless Steels

| Impact Value of the Base Metal (kg/cm²) | | | | | |
|---|---|---|---|---|---|
| Temperature (° C) | −25 | 0 | 25 | 50 | 75 |
| Sample No. | | | | | |
| 1 | 2.8 | 6.3 | 8.8 | 11.2 | 11.9 |
| 2 | 1.0 | 2.0 | 6.0 | 9.0 | 10.0 |
| 3 | 0.9 | 2.3 | 16.0 | 17.5 | 17.5 |

| Impact Value of the Weld Zone (kg/cm²) | | | | | | Remarks Corres-Ponding |
|---|---|---|---|---|---|---|
| Temperature (° C) | −25 | 0 | 25 | 50 | 75 | AISI grade |
| 1 | 2.0 | 1.6 | 2.9 | 7.2 | 6.8 | 405 by literature |
| 2 | 0.5 | 0.5 | 0.6 | 0.7 | 0.9 | 430 |
| 3 | 0.5 | 0.4 | 17.8 | 18.5 | 18.7 | Ti added 430 |

Measurements are obtained from sub-sized ($t=5$) test pieces.

As described above, it is understood that the addition of Ti to a ferritic stainless steel has a remarkable effect on the toughness at room temperature, but it does not contribute to the improvement of the toughness at low temperature.

SUMMARY OF THE INVENTION

Therefore, one of the objects of the present invention is to provide a ferritic stainless steel free from the above difficulties, and which possesses remarkably improved toughness both in the base metal and the weld zone, as well as excellent corrosion resistance (as measured by salt spray and Huey tests) in the weld zone similar to or better than that of the base metal.

The present inventors have conducted extensive studies on the effects of various alloying elements on the toughness of a ferritic stainless steel, and have found that toughness of a ferritic stainless steel both in the base metal and the weld zone, particularly the toughness at low temperatures, can be improved without damaging the other mechanical properties and workability by adding Mn and Al with lowered amounts of C, N, and Si and with the addition of other known alloying elements (mainly Ti).

Particularly, the present inventors have found that by decreasing the C, N, and Si concentrations, adding Ti (alone or in combination with Nb) and maintaining the Mn concentration between $1.0<Mn<2.5\%$, the $Cr_{23}C_6$ precipitates in the grain boundary has an average length of not more than about 2microns, and consequently, the steel possesses the concomitant properties of high toughness and workability.

Indeed, applicants have discovered a new ferritic stainless steel which possesses properties which were considered impossible to impart to such a material. Namely, improved low temperature toughness and ductility of the weld zone along with superior workability and mechanical properties.

It has been found that excellent various properties can be obtained when the addition of Ti, which is an important element to be added in the present invention, is limited to the range from 0.05 to 0.2% measured on the basis of the amount of Ti in solid solution in the steel matrix. This is the Ti amount which is effective for improving the toughness of a ferritic stainless steel, both in the base metal and the weld zone, provided that the effective Ti amount = total Ti − (4×C% + 24/7×N%).

Further, the present inventors have found that a small amount of Nb is also effective in improving the toughness of both the base metal and the weld zone of the stainless steel when Ti and Mn are added with lowered contents of C, N, and Si. In the above cases, as the carbon is fixed by carbide formation, the formation of austenite and martensitization are prevented and, in turn, the coarsening of ferrite grains is prevented so that toughness in the weld zone of the steel can be improved.

Thus, the present invention comprises a ferrite stainless steel which, on welding, produces high toughness both in the weld zone and the base metal and which is composed of:

$C \leqq 0.05\%$ $Si \leqq 0.7\%$ $1.0\% < Mn < 2.5\%$ $Cr = 10\%$ to $19\%$ $Ti = 5 \times C\%$ to $0.5\%$ $N \leqq 0.03\%$ Al = from the residue remaining after deoxidation up to 0.5%, and wherein the $Cr_{23}C_6$ precipitate in the grain boundary has an average length of not more than about two microns.

Balance: Fe and unavoidable impurities, and wherein $0.05\% \leqq$ amount of effective Ti $\leqq 0.2\%$ in which the amount of effective Ti is equal to total Ti − (4 × C% + 24/7 × N%) and having a workability in the range from equal to or greater than about 6 mm in Erichsen value in both the base metal and weld zone and a low temperature toughness equal to or greater than 5 kg/cm$^2$ at −20° C in both the base metal and the weld zone. As used herein, the Erichsen value is determined on a 1.5 mm thick plate and the low temperature toughness is determined on a sub-size Charpy test piece with a thickness of 5 mm.

Preferably, the steel on welding possesses Erichsen value of equal to or greater than 10.0 mm and 6 mm in the base metal and weld zone, respectively, and low temperature toughness equal to or greater than 6 kg/cm$^2$ and 5 kg/cm$^2$, in the base metal and weld zone, respectively.

In a preferred embodiment, the above steel composition contains Nb, such that, $(Nb + Ti) = (C\%) \times 5$ to 0.6%.

Also, the steel of the present invention possesses superior antiridging properties. Particularly, the steel exhibits ridging of less than about 20 microns and preferably, less than about 10 microns after cold rolling the steel twice.

DESCRIPTION OF THE PREFERRED EMBODIMENT

Figure 1:
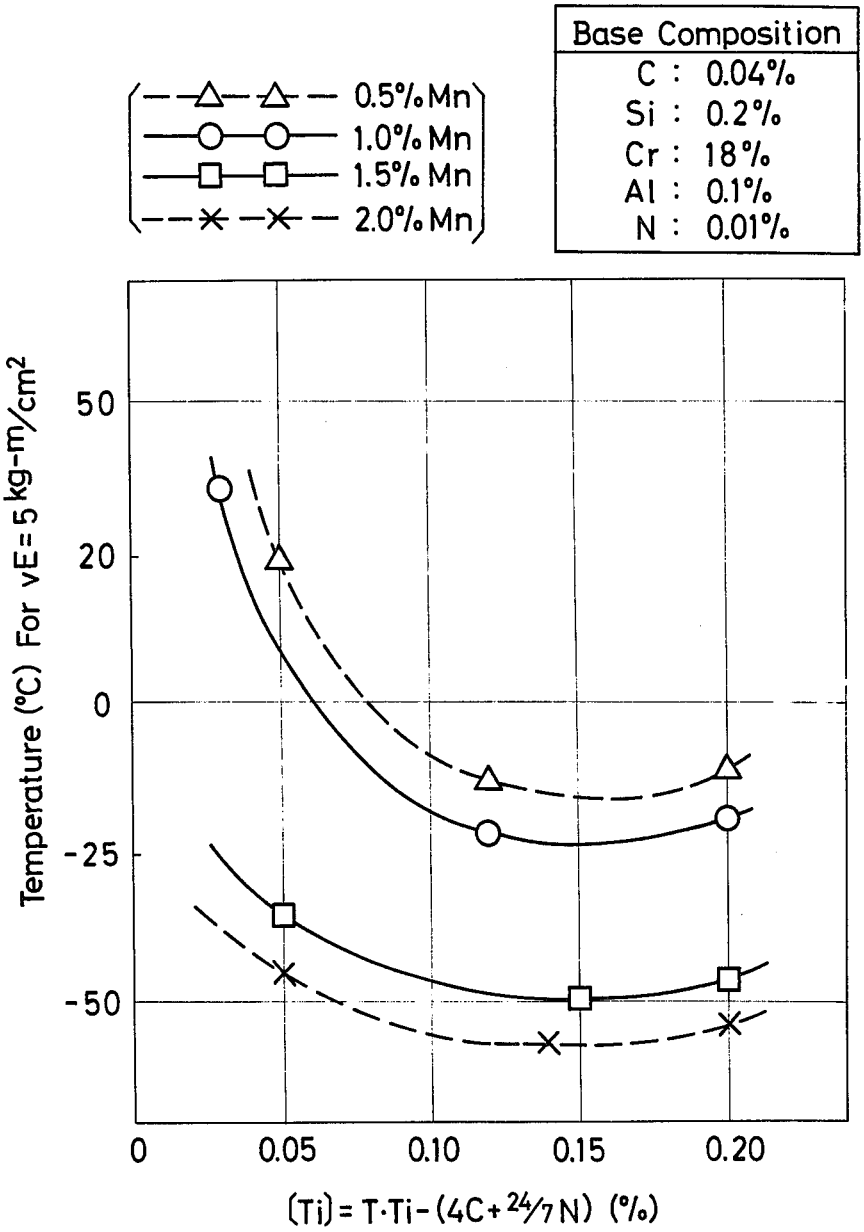
FIG. 1 is a graph illustrating the influence of the effective titanium and manganese contents on the toughness of the weld zone.

The reasons for the limitations of the contents of the alloying elements in the present invention are as follows:

Carbon expands the $\gamma$ zone in the phase diagram of a chromium steel and produces austenite depending on the chromium content and produces martensite depending on the cooling rate after heating. Therfore, the carbon content should be maintained as low as possible because if it is present in excess, it can damage the toughness as well as the workability in a heataffected zone. Another aspect of an excessive increase in the C content is that the addition of a correspondingly increased amount of Ti causes a large amount of TiC to be precipitated in the steel matrix and also causes an increase in the amount of C rejected from Ti, i. e., not incorporated into TiC, which, in turn, causes production of adverse effects on the various properties of the steel. Based on this fact, the upper limit of the range of the C content is defined as 0.05%. When the C content exceeds 0.05%, the degree of Ti-addition effect on the improvement of toughness and workability is lowered, and, at the same time, it is made more difficult to suppress formation of martensite in the welded zone under the action either of Ti alone or a combination of Ti and Nb. For purposes of effecting more prominent improvement of toughness and workability in the weld zone, it is preferred to adjust the C content to less than 0.03%.

Although it is desirable to maintain the silicon content as low as possible because it deteriorates the toughness of a ferritic stainless steel, the presence of a small amount of silicon cannot be avoided because it is indispensable for the steel making reactions, and an excessively low silicon content lowers the oxidation resistance of the steel at high temperatures.

This becomes very serious particularly on the low Cr side. In the case of 11% Cr steel, a somewhat larger amount of Si must be added, or otherwise it would be impossible to assure a sufficent resistance to oxidation in open air at 800° C and to gases exhausted from engines. As the Si content increases from 0.7%, however, the toughness, particularly at the weld zone, rapidly deteriorates. With this in mind, the upper limit of the Si content is defined as 0.7%.

Manganese is effective to improve the tensile strength, yield strength, and toughness without lowering elongation and reduction of the steel and is also effective to improve the hot workability. Although the effects of the manganese depend on the carbon content, they are remarkable with a manganese content higher than 1.0% so long as the carbon content is not more than 0.05%.

On the other hand, an excessive manganese content produces unstable austenite which transforms into martensite during cooling resulting in deterioration of the various properties and, particularly, the toughness and in embrittlement. Therefore, the manganese content is limited to a range from more than 1.0% to less than 2.5%.

What should be noted here is that manganese improves the toughness of the weld zone remarkably by the synergistic effect of the combination of Ti, C and N.

It has been found from the extensive studies conducted by the present inventors that manganese not only improves the material properties as mentioned above, but also, it remarkably improves the thoughness of the weld zone if it is added together with an appropriate amount of Ti and with lowered C and N.

Ti readily combines with C and N, and these elements form TiC and TiN which precipitate in the grains and lower the C and N contents in the ferrite so that the toughness and ductility are improved. However, the formation of TiC (TiN) varies depending on the heat history of the steel and in the case of the welded portion which is cooled relatively rapidly from high temperatures, most of the C precipitates as chromium carbide in spite of a titanium content of more than 5 times the carbon content. Further, the structure remains as a ferrite single phase at high temperatures so that the carbon precipitates and grows in a high temperature zone and gathers along the grain boundaries to lower the toughness.

Thus, when C is controlled and Ti is added alone, improvement of the low temperature toughness can not be obtained. However, with the addition of Mn, the solid solution of C in the ferrite increases and the precipitation of carbides from the ferrite is delayed so that the carbide precipitation can be prevented. As will be explained hereinafter in connection with FIG. 3, Mn addition excedding 1.0% is effective to prevent large precipitates in the grain boundaries.

The addition of Ti is effective to fix the N and a part of the C as mentioned before, and excessive addition of Ti produces no additional effect. Thus, an appropriate content of Ti is not more than $5 \times C\% - 0.5\%$ as a whole including the base metal.

Further as will be explained in connection with FIG. 2 hereinafter, after the Ti fixes the C and N, it is necessary for the additional Ti to be in solid solution which is favorable for the ductility and workability to satisfy the condition.

$$0.05\% \leqq \text{solid solution Ti} (= \text{Total Ti} - (4C + 24/7N) \leqq 0.2\%$$

Thus, the effects of Mn, Ti C and (N) on the toughness of the welded portions are synergistic and result from the following facts:

Firstly, with the addition of Ti, TiC and TiN are are formed so that:

(1) coarsening of ferrite grains is prevented, and
(2) contents of C and N in the ferrite are reduced;
Then, with the addition of the appropriate amount of Mn
(3) chromium carbide precipitate in the ferrite grain is prevented or controlled to produce fine grains.

Particularly, and as will be shown hereinafter, the Mn addition controls and maintains the $Cr_{23}C_6$ precipitate in the grain boundary to an average length of less than 2 microns.

In order to develop the above effects fully, Mn and Ti should be within the following ranges:

$$1.0\% < Mn < 2.5\%$$
$$0.05\% \leqq [\text{effective Ti}] = T.Ti - \{(4C\% + 24/7 N\%)\equiv \leqq 0.2\%.$$

The reasons for defining the upper and lower limits of Mn have been already set forth hereinbefore.

Chromium is a principal element for providing corrosion resistance and oxidation resistance. At a chromium content less than 10%, both corrosion and oxidation resistance decreases sharply, but on the other hand, with a chromium content beyond 19%, the ductility and toughness decrease. Thus, the chromium content is defined in the range from about 10 to not more than 19%.

Aluminum is required to be present in an amount as is usually added as deoxidizing agent in order to refine the grain size through its solid dissolution into the steel matrix and to improve the toughness of the weld zones. However, if the aluminum content exceeds 0.5%, the workability and ductility deteriorate. The preferred aluminum content is not more than 0.05%.

After such deoxidation, a residual amount of soluble aluminum remains in the steel. This residue can be minimal, although there will always be some Al left after the deoxidation. In no case, however, should the amount remaining be greater than 0.5%.

Nitrogen is an austenite former, and has an effect similar to carbon. Therefore, a large nitrogen content is not desirable. Also nitrogen combines with Al and Ti to form AlN and TiN and suppresses coarsening of the grains but in essence it offsets the effects of Al and Ti. Conversely, increasing the N content will require the addition of a correspondingly increased amount of Ti. If so, a large amount of TiN is caused to precipitate in the steel as in the case of C, and the amount of N rejected from the Ti is increased, and thereby the effectiveness of Ti addition is diminished. As the N content is increased from 0.03%, the toughness and ductility of the steel rapidly decrease with an increase in the hardness. By taking this fact into account, the upper limit of the N content is defined as 0.03%.

The phosphorus content is limited to not more than 0.04% because it deteriorates the toughness, and the upper limit of sulphur is limited to 0.03% because it often causes pitting corrosion when aluminum is added.

Further, in the present invention, up to 2.0% nickel may be added for the purpose of improving the strength should it be necessary for the particular end purpose involved.

Niobium in a manner similar to titanium, is effective to fix the carbon and nitrogen by carbide and nitride formation, and prevents both austenite formation and martensitization and simultaneously prevents the coarsening of the ferrite grains. For this purpose, niobium is added in the form of (Nb + Ti) in an amount of not less than 5 times the carbon content. However, an excessive addition of niobium causes cracking (high-temperature crack and cold crack) in the weld zones. The upper limit of niobium which does not cause cracking correlates with the titanium addition, and increases in proportion with the titanium addition. In the case of the addition of niobium alone, when niobium is added in an amount exceeding 0.3%, cracking is caused during welding, but when 0.2% titanium is present, niobium can be added up to 0.4% without causing the cracking. Further, when 0.5% titanium is present, up to 0.8% niobium can be safely added. However, from the standpoint of the fluidity of the molten metal pool at the time of welding, it is necessary to maintain (TI + Nb) to not more than 0.6%.

Further, when an excessive amount of titanium is added, delicate surface defects commonly called Ti streak sometimes occur on the surface of a cold rolled steel sheet, but as part of this excessive Ti is replaced with Nb, this surface defect is prevented.

Steel sheets having such surface defects are often unsuitable for applications where the surface condition is important, for example, where the exposed steel surface is utilized to take advantage of the unique mirror luster inherent to the stainless steel. For use in such applications, it is desirable to maintain the titanium content lower than 0.2% and increase the niobium contents, and control the total amount of (Nb + Ti) between 5 and 6 times the carbon percentage so as to avoid such surface defects.

In the case of the addition of titanium alone, in order to prevent deterioration of the surface condition caused by surface defects, such as, the Ti streak due to the formation of titanium nitride, oxide and carbide, it is also effective for titanium to be present in the inner layer of the plate thickness and with no titanium present in the surfacial layers, or for very small amounts of titanium to be present within a range which does not deteriorate the surface condition.

The stainless steel sheet in which the effective titanium content is defined according to the present invention shows a very excellent Rankford value, $\bar{r}$ value which indicates deep-drawability. Theoretically, it is assumed that a texture having (111) effective for the improvement is obtained by the titanium addition. It is another advantage of the stainless steel according to the present invention that it is almost free from the ridging or roping which is a striped pattern appearing in the pulling direction on the surface of 17 Cr ferritic stainless steels.

Figure 2:
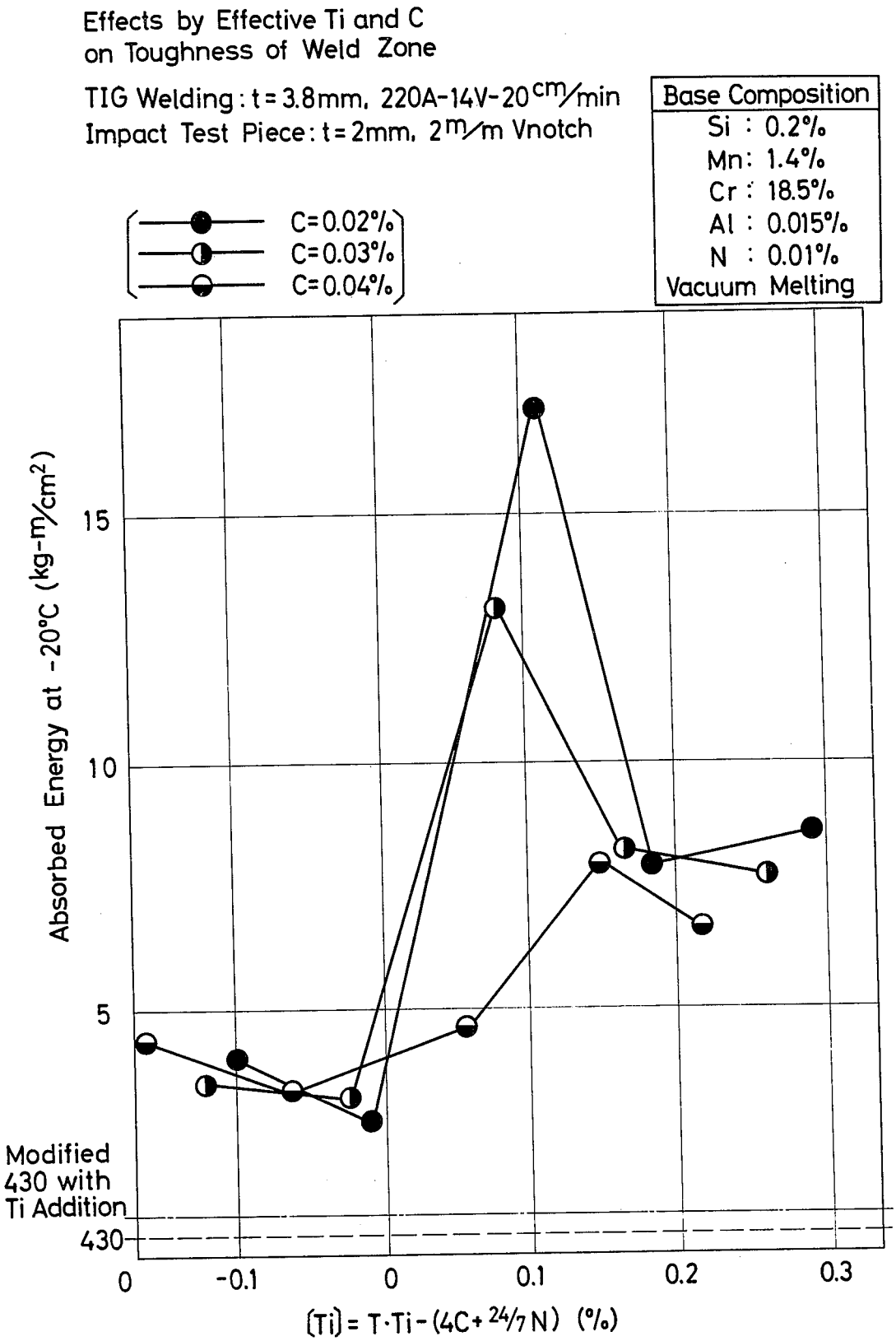
FIG. 2 is a graph illustrating the influence of the effective titanium content and the carbon content on the toughness of the weld zone.

The correlation between the titanium content and the contents of Mn and C have been described hereinbefore and are confirmed as shown in FIG. 1 and FIG. 2.

In FIG. 1, the amounts of effective Ti are plotted along the horizontal axis and the temperature (° C) for attaining a $vE = 5$ kg-m/cm$^2$ of the weld zones is plotted along the vertical axis, at various manganese contents of 0.5%, 1.0%, 1.5% and 2.0%. As shown by FIG. 1, when the effective titanium content is between 0.05 and 0.2%, which is within the scope of the present invention and the manganese content is 0.5%, the temperature is −15° C at highest, and when the manganese content is 1.0% with the same titanium content, the temperature is −25° C.

In contrast, when the manganese content is within the scope of the present invention, the temperature is −50° C with a manganese content of 1.5% and −60° C with a manganese content of 2.0%. This indicates that the stainless steel of the present invention possess toughness two to three times better than that of conventional steels.

Thus, in the conventional ferritic stainless steels, manganese can be added only up to about 1.0%, while in the present invention, a larger amount of manganese can be added in relation to the content of effective titanium without sacrificing workability, and excellent toughness in the weld zone can be obtained.

FIG. 2 shows the effects of the effective titanium contents and the carbon contents on toughness in the weld zone. In the figure, the amounts of effective titanium are plotted along the horizontal axis and the impact values (absorbed energy value at −20° C in kg-m/cm$^2$) of the weld zone are plotted along the vertical axis. As understood from the figure, when the carbon content is not more than 0.05%, particularly not more than 0.03%, and the amount of effective titanium is between 0.05 and 0.2% as defined in the present invention, the absorbed energy at −20° C shows a very high value ranging from 8 kg-m/cm$^2$ to 17 kg-m/cm$^2$. In contrast, AISI 430, a conventional ferritic stainless steel having high C and Si contents, and another conventional ferritic stainless steel having the same basic composition but lowered C and Si contents and containing Ti show only very low absorbed energy values of 0.4 kg-m/cm$^2$ and 0.8 kg-m/cm$^2$ (dotted line) respectively, as shown in the lower part of FIG. 2.

Thus, it is understood from FIG. 1 and FIG. 2, that when the effective titanium content is between 0.05 and 0.2%, while the carbon content is not more than 0.05% and the manganese content is between 1.0% and 2.5% in the present invention, the temperature for attaining a $vE = 5$ kg-m/cm$^2$ and the absorbed energy value in the weld zone each are at highly desirable values, and it is easily understood that the stainless steel according to the present invention is quite excellent as compared with the conventional stainless steels.

The present invention will be more clearly understood from the following examples.

EXAMPLE 1

Various modified steel compositions based on 17% Cr steel were prepared and the toughness in the base metal and weld zone was estimated. In order to strictly control the contents of elements, such as, C, N, O, Al and Ti, the steel compositions were all prepared in 50 kg ingots by vacuum melting. The steel ingots thus obtained were forged into slabs, and hot rolled to obtain hot rolled steel sheets of 6 mm thickness. The steel sheets were annealed at 860° C for 60 minutes in vacuum, slowly cooled down to 600° C, taken out of the annealing furnace, and cooled in the air. Then sub-sized V-Charpy test pieces of 5 mm thickness were prepared therefrom and subjected to impact tests to estimate the toughness of the non-welded material.

As for the impact test of the weld zone, the tests were performed as follows. The hot rolled steel sheets were butt-welded by TIG welding, and Charpy test pieces were prepared by providing a 2 mm V-notch at the center of the weld zone and tests were done under the "as welded" condition.

TABLE 2

Steel Compositions and Impact Values

| Sample No. | Remarks | Nb | C | Si | Mn | Ni | Cr | Al | Ti | N |
|---|---|---|---|---|---|---|---|---|---|---|
| | | | Steel Compositions | | | | | | | |
| A | AISI 430 | | 0.07 | 0.52 | 0.54 | | 16.9 | — | — | 0.025 |
| B | Low carbon 430 | | 0.01 | 0.40 | 0.54 | | 16.8 | — | — | 0.013 |
| C | Ti containing 430 | | 0.01 | 0.50 | 0.57 | | 16.5 | — | 0.31 | 0.015 |
| D | Al . Ti containing 430 | | 0.01 | 0.09 | 0.15 | | 16.7 | 0.02 | 0.33 | 0.011 |
| E | Present invention | | 0.01 | 0.15 | 1.48 | | 16.8 | 0.02 | 0.30 | 0.009 |
| F | No Al addition | | 0.01 | 0.16 | 1.52 | | 16.6 | — | 0.32 | 0.010 |
| G | Present invention | | 0.03 | 0.18 | 1.02 | | 16.5 | 0.03 | 0.33 | 0.014 |
| H | " | | 0.01 | 0.14 | 1.12 | | 13.2 | 0.01 | 0.31 | 0.011 |
| I | " | | 0.01 | 0.16 | 1.53 | | 18.5 | 0.02 | 0.30 | 0.12 |
| J | " | | 0.01 | 0.14 | 1.40 | | 16.8 | 0.02 | 0.32 | 0.013 |
| K | " | | 0.03 | 0.15 | 1.80 | | 16.5 | 0.03 | 0.34 | 0.011 |
| L | Present invention | 0.12 | 0.034 | 0.22 | 1.53 | | 17.5 | 0.016 | 0.20 | 0.023 |
| M | " | 0.15 | 0.015 | 0.53 | 1.14 | | 17.6 | 0.022 | 0.28 | 0.009 |
| N | " | 0.11 | 0.032 | 0.24 | 2.02 | | 17.8 | 0.019 | 0.19 | 0.025 |
| S | Al . Ti containing 430 | | 0.01 | 0.16 | 0.82 | | 16.3 | 0.03 | 0.29 | 0.009 |
| Y | Present invention | | 0.01 | 0.16 | 1.03 | | 16.9 | 0.03 | 0.30 | 0.011 |

| Sample No. | Remarks | Impact Values: Base Metal −20°C | Base Metal 0° C | Base Metal 20° C | Base Metal 40° C | Weld Zone −20° C | Weld Zone 0° C | Weld Zone 20° C | Weld Zone 40° C |
|---|---|---|---|---|---|---|---|---|---|
| A | AISI 430 | 1.0 | 2.0 | 6.5 | 7.2 | 0.6 | 0.5 | 0.6 | 0.7 |
| B | Low carbon 430 | 1.3 | 2.1 | 6.5 | 8.0 | 0.6 | 0.5 | 2.5 | 4.0 |
| C | Ti containing 430 | 0.9 | 2.3 | 16.0 | 17.2 | 0.5 | 0.4 | 17.8 | 18.1 |
| D | Al . Ti containing 430 | 4.1 | 6.5 | 16.5 | 18.5 | 0.8 | 3.2 | 15.2 | 16.0 |
| E | Present invention | 10.8 | 12.1 | 16.0 | 17.3 | 8.7 | 11.2 | 14.5 | 17.2 |
| F | No Al addition | 5.0 | 7.2 | 16.8 | 18.2 | 0.9 | 1.8 | 15.2 | 16.4 |
| G | Present invention | 8.3 | 10.1 | 15.3 | 16.5 | 6.2 | 9.8 | 15.2 | 18.1 |
| H | " | 14.2 | 15.1 | 17.2 | 16.8 | 12.6 | 14.3 | 16.3 | 18.5 |
| I | " | 9.2 | 11.7 | 14.5 | 16.0 | 6.0 | 10.5 | 14.3 | 14.7 |
| J | " | 11.2 | 12.4 | 16.4 | 17.5 | 9.1 | 11.9 | 16.3 | 17.9 |
| K | " | 9.5 | 11.2 | 15.8 | 17.2 | 7.3 | 10.8 | 15.8 | 17.9 |
| L | Present invention | 11.0 | 16.5 | 18.2 | 18.7 | 6.4 | 11.6 | 14.5 | 15.5 |
| M | " | 12.8 | 17.9 | 18.0 | 18.7 | 11.0 | 15.1 | 14.7 | 15.8 |
| N | " | 11.4 | 16.0 | 18.1 | 18.9 | 6.3 | 11.9 | 14.8 | 14.9 |
| S | Al . Ti containing 430 | 9.3 | 11.2 | 15.3 | 17.0 | 2.6 | 8.1 | 16.6 | 15.9 |
| Y | Present invention | 7.5 | 10.1 | 16.2 | 18.1 | 7.8 | 12.1 | 17.2 | 17.2 |

The sample A corresponds to AISI 430 steel and shows a transition temperature between 10 and 20° C, and a very low absorbed energy at a temperature of 0° C or lower, and 7.2 kg-m/cm$^2$ at 40° C. The absorbed energy of the weld zone by TIG welding of sample A is very low, i. e., 0.7 kg-m/cm$^2$, even at 40° C. Whereas in the case of sample B containing lower C and N contents, the absorbed energy increases generally, but the transition temperature remains almost the same. However, in case of the sample C in which 0.3% Ti is added, the absorbed energy increases at room temperature and higher temperatures, and the values of the weld zone increase remarkably.

Further, when 0.02% Al is added as in sample D, the toughness of both the base metal and the weld zone is improved, mainly at low temperatures, but the toughness of the weld zone at −20° C is still low.

In sample S to which 0.82% Mn is added, although there is some improvement in the low temperature toughness, the improvement in the low temperature toughness of the weld zone is insufficient.

In the case of sample E of the present invention in which 1.5% Mn is further added, the toughness of both the base metal and the weld zone are remarkably improved. In sample F which has almost the same composition as sample E, but is not deoxidized with Al, the toughness of the weld zone is remarkably low at low temperatures.

Sample G of the present invention which contains a slightly higher carbon content of 0.03% shows generally lower impact value as compared with sample E, but provides a high level of toughness both in the base metal and the weld zone. The samples H and I of the present invention contain 13% Cr and 18% Cr, respectively, and also exhibit considerably high toughness both in the base metal and the weld zone. It is also shown that the samples J, K, and Y give slightly higher toughness in general as compared with the samples E and G, and further that the samples L, M, and N in which Ti and Nb are added in combination are much more excellent than samples A, B, C, D and F which correspond to AISI 430 steel.

As described above, a steel having excellent toughness, both in base metal and weld zone can be obtained only when the level of C and N contents is restricted, Mn is added, Al deoxidation is effected, and further Ti is added or still further Ti and Nb are added in combination in the ranges prescribed by the present invention. If any of C, N, Mn, Al or Ti deviate from the range as defined by the present invention, the toughness of the base metal and the weld zone decreases remarkably. Thus, it is clear that these alloying elements have a strong cooperative action with each other and control the material toughness. In this example, all of the steels were prepared by vacuum melting, but similar results can be obtained even with air-melted steels if the nitrogen content is maintained relatively low.

Figure 9:
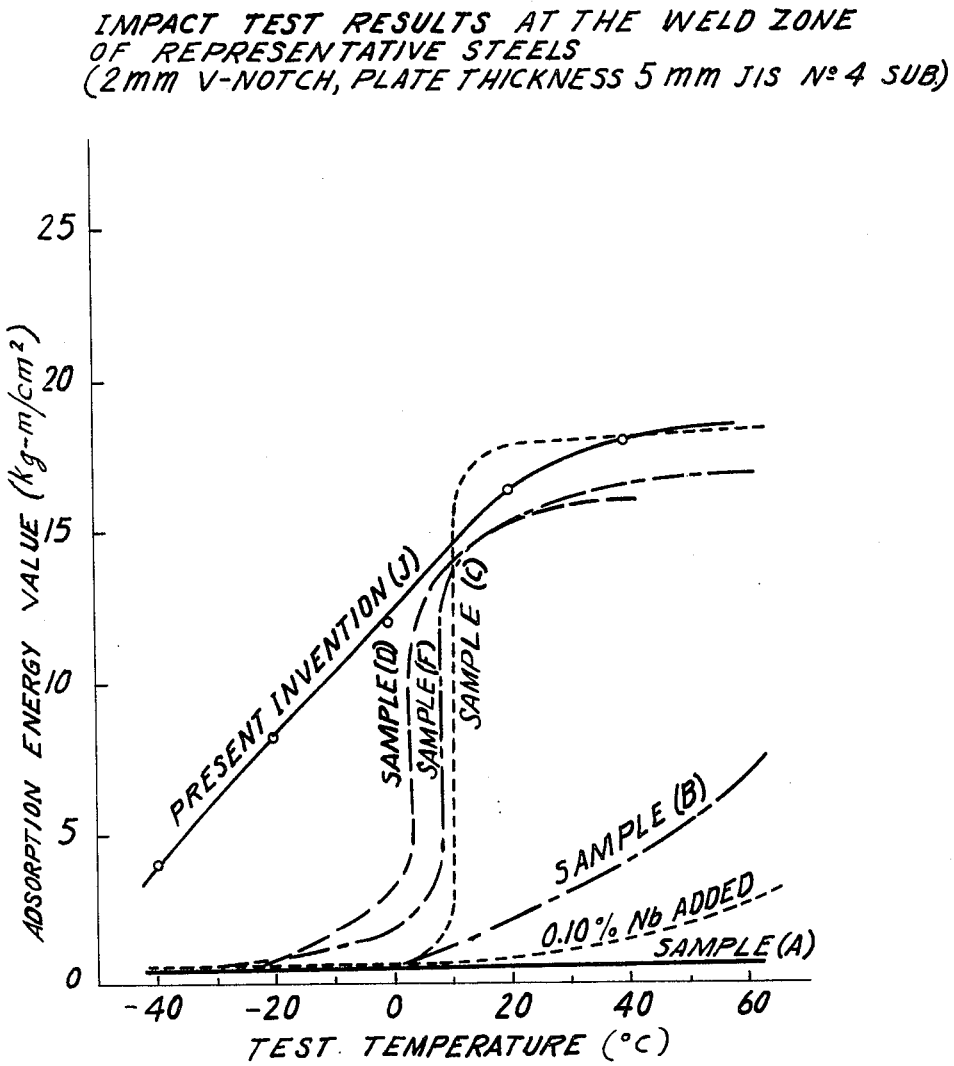
FIG. 9 is a graph illustrating the variation of impact test results at different temperatures of the weld zone of steel compositions set forth in Table 2 hereof.

The greatly improved synergistic effect of the combination of the present invention is shown in FIG. 9 wherein absorption energy values of the weld zone for various of the samples prepared in Example 1 are plotted graphically versus the temperature. It is important to note in this regard, that a significant characteristic of the present invention resides in its "as welded" properties and not just the properties of the steel as produced. Particularly, the present steel possesses a workability in the range from equal to or greater than about 6 mm in Erichsen value in both the base metal and weld zone and a low temperature toughness equal to or greater than about 5 kg/cm$^2$ at −20° C in both the base metal and the weld zone. As used herein, the Erichsen value is determined on a 1.5 mm thick plate and the low temperature toughness is determined on a sub-size Charpy test piece with a thickness of 5 mm.

Preferably, the steel on welding possesses Erichsen value of equal to or greater than 10.0 mm and 6 mm in the base metal and weld zone, respectively, and low temperature toughness equal to or greater than 6 kg/cm$^2$ and 5 kg/cm$^2$, in the base metal and weld zone, respectively.

In FIG. 9, a typical steel designated AISI 430 (Sample A) produces a toughness in the weld zone which is measured as low as about 0.6 kg-m/cm$^2$ over the entire range of test temperatures from −40° C to +60° C. In the case of the low carbon 430 (Sample B) with a content smaller than that of AISI 430, although the absorption energy value at 60° C is increased to 7 kg-m/cm$^2$, the toughness at low temperatures is as low as that of AISI 430. The Ti-containing sample (D), resulting from Ti addition to the low-carbon 430, and the no-Al addition sample (F), both have good toughnesses at temperatures higher than 20° C, but exhibit a low toughness of 3 kg-m/cm$^2$ (similar to that of AISI 430) when the temperature is decreased from 0° C.

In contrast to these samples of conventional steels, an example of the steel of the present invention (Sample J) not only has an improved toughness at temperatures higher than room temperature when Mn, Al and Ti (or Ti+Nb) are added, but also exhibits largely increased absorption energy values of 11.9 kg-m/cm$^2$ and 9.1 kg-m/cm$^2$ at temperatures of 0° C and −20° C respectively. It follows that the low temperature toughness of the weld zone is improved over the prior art.

This important synergistic effect is further evident from FIGS. 1 and 2 of the specification. In FIG. 2, the difference between the effect of C-Si-Ti and the synergistic effect of C-Mn-Ti-Al is shown. As indicated by the dashed line, the addition of Ti to AISI 430 (C ≈ 0.06%, Si = 0.5%, N ≈ 0.015%) produces no effect, as the resultant steel with [Ti] = −0.2% to +0.3% produces a toughness of 0.6 kg-m/cm$^2$ by the weld zone. Further, as indicated by the dot-and-dash line, when the addition of Ti (result: [Ti] = −0.2% to +0.3%) is combined with the reduction of C and Si (result: C = 0.02%, Si = 0.2%), the toughness is increased to some extent by the reduction of C and Si, where nevertheless permitting the low temperature toughness to remain at a level as low as that of the steel indicated by the dashed line.

These facts suggest that it is impossible to improve commercially available ferritic stainless steels with respect to the low temperature toughness of the weld zone inasmuch as the quantitative change of C, Si and Ti is employed as the only one controllable factor.

Experiments have also been conducted with a number of commercially available ferritic stainless steels of different compositions and the results are tabulated in Table 2 A.

TABLE 2 A

| Steel Sample | Composition C | Mn | Cr | Al | Ti | Mo | Weld Zone Toughness (kg-m/cm$^2$) −20° C | 0° C | Erichsen Value (t=1.5mm) at +20° C |
|---|---|---|---|---|---|---|---|---|---|
| AISI 405 | 0.05 | 0.5 | 11.8 | 0.20 | | | 0.8 | 1.6 | 1.5 |
| AISI 410 | 0.05 | 0.5 | 12.0 | | | | 0.5 | 0.6 | 1.6 |
| AISI 409 | 0.03 | 0.5 | 11.8 | | 0.20 | | 0.4 | 2.5 | 5.9 |
| AISI 430 | 0.06 | 0.5 | 16.5 | | | | 0.6 | 0.6 | 1.8 |
| AISI 434 | 0.06 | 0.5 | 16.7 | | | 1.1 | 0.4 | 0.5 | 1.2 |
| Our steel (J) | 0.01 | 1.4 | 16.8 | 0.020 | 0.32 | | 9.1 | 11.9 | 10.5 |

Note: The testing and welding were carried out according to the same methods as those employed in Example 1.

As is understandable from the above Table, these conventional ferritic stainless steel of the 400 series are inferior in low temperature toughness and ductility. Even with AISI 405 and AISI 409 which have been said to have improved weldability by the addition of either Al or Ti, the toughness and ductilities are very low as compared with the present steel (J).

Figure 3A:
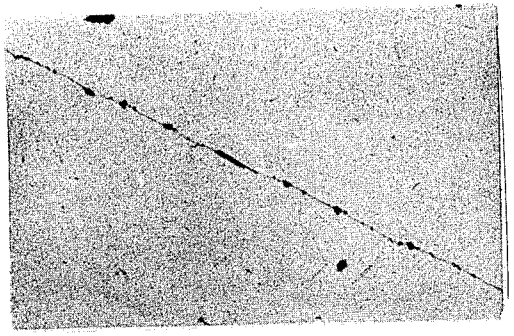
FIGS. 3*a, b, c,* 4*a, b, c,* 5*a, b,* 6*a, b,* 7*a, b,* and 8*a, b* are photomicrographs at various powers of magnification showing distribution and sizes of carbide precipitates along grain boundaries of samples having varying Mn contents.
Figure 3B:
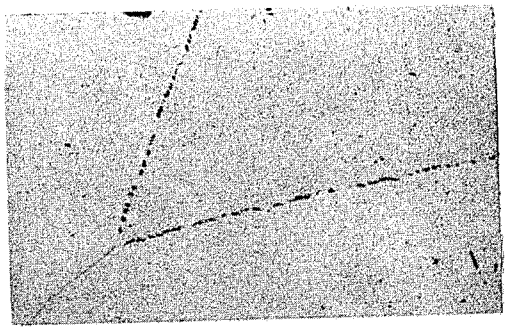
Figure 3C:
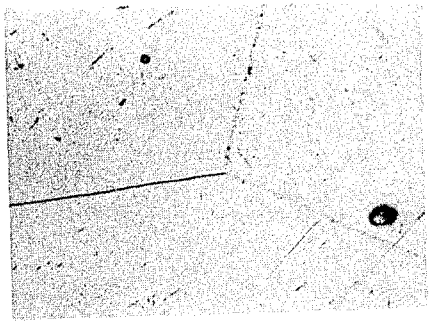
Figure 4A:
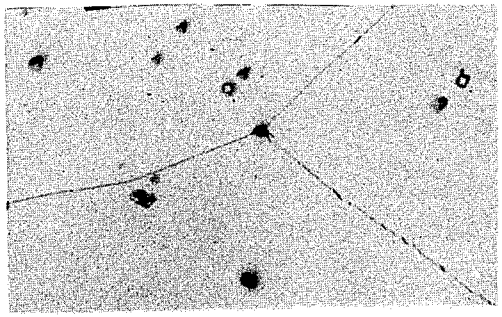
Figure 4B:
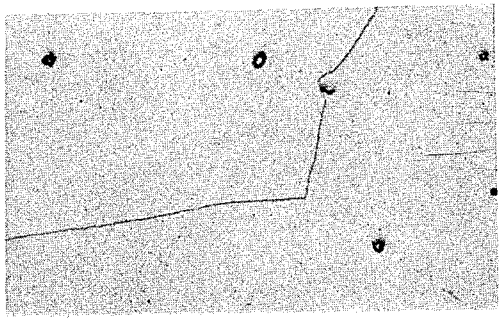
Figure 4C:
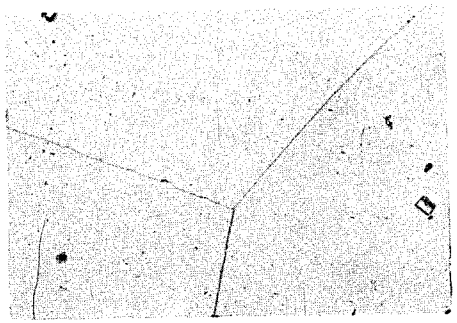

FIGS. 3 *a,b,* and *c,* and 4 *a,b,* and *c,* are photo micrographs of the intergranular precipitates for samples D and J, respectively. These photos clearly show the significant decrease in intergranular precipitation when a Mn content within the range specified for the present invention is used, i.e., sample D contains 0.15% Mn and sample J contains 1.4% Mn with the remainder of the elements being essentially equivalent.

Figures 5A, 5B:
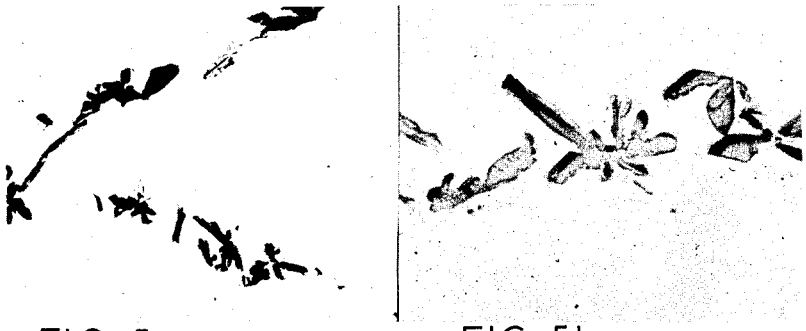
Figures 6A, 6B:
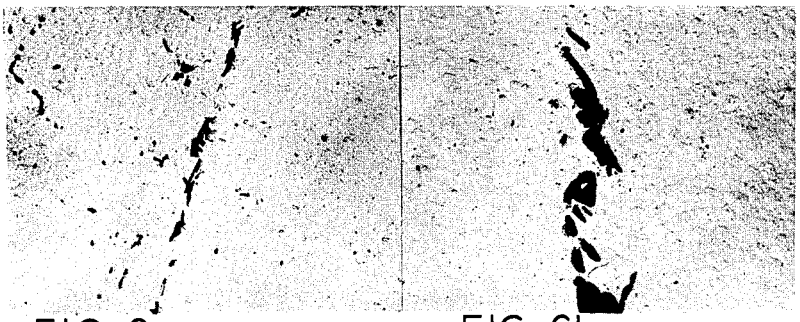
Figures 7A, 7B:
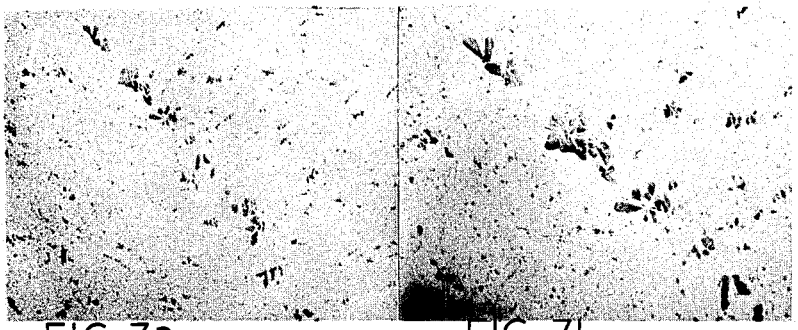
Figures 8A, 8B:
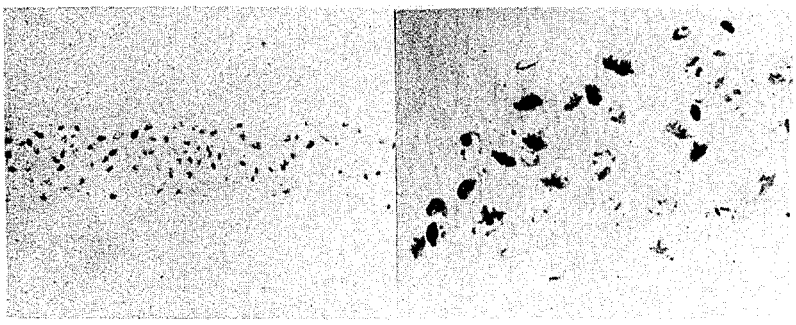

FIGS. 5 *a,* and *b,* 6 *a* and *b* 7 *a* and *b,* and 8 *a* and *b* are electron photomicrographs of samples D, S, Y and J, and illustrate the decrease in size of the intergranular precipitate ($Cr_{23}C_6$) with increasing Mn content.

EXAMPLE 2

Some typical grades of the steels used in Example 1 were worked into cold rolled steel sheets of 1.5 mm thickness, annealed at 830° C for 5 minutes, and their mechanical properties were measured. Also these steel sheets were butt-welded by TIG welding and Erichsen tests were conducted around the center of the weld zone to estimate the ductility of the weld zone. The results are shown in Table 3.

TABLE 3

Mechanical Properties and Ductility in Weld Zone of Cold Rolled Steel Sheets (Tensile Test was done with JIS 13-B specimens)

| Sample No. | Base Metal: Yield Strength (Kg/mm$^2$) | Tensile Strength (Kg/mm$^2$) | Uniform Elongation (%) | Total Elongation (%) | $\bar{r}$ | n | Hv | Er (mm) | Weld Zone Er (mm) |
|---|---|---|---|---|---|---|---|---|---|
| A AISI 430 | 29.0 | 49.1 | 19.0 | 30.5 | 1.00 | 0.225 | 162 | 10.5 | 1.8 |
| E Present Invention | 28.2 | 45.5 | 21.3 | 33.8 | 1.33 | 0.213 | 135 | 11.4 | 10.9 |
| G " | 31.1 | 48.0 | 20.2 | 32.0 | 1.18 | 0.209 | 154 | 10.9 | 10.1 |
| J " | 32.3 | 52.1 | 21.8 | 33.5 | 1.27 | 0.229 | 157 | 11.0 | 10.5 |
| K " | 32.8 | 53.7 | 19.9 | 31.5 | 1.20 | 0.231 | 165 | 10.8 | 10.0 |
| M " | 26.5 | 46.8 | 22.7 | 35.5 | 1.45 | 0.238 | 138 | 11.9 | 10.8 |

As shown in Table 3, samples E. G, J, and K (present invention) and the sample M in which Ti and Nb are added in combination show no substantial change in their mechanical properties as compared with sample A (corresponding to AISI 430). Also, as for the Erichsen value in the weld zone, sample A has a low value of 1.8 mm, while the steels of the present invention give a value of 10 mm or more which is almost the same as that in the base metal. These results clearly prove that the ductility and stretchability in the weld zone of the steels according to the present invention are excellent as compared with the conventional ferritic stainless steel.

After the welding, the welded pieces were ground to a 2 mm thickness, and Charpy test pieces (sub-size) and test pieces having the weld zone at their center for JIS 13-B tensile test were taken therefrom.

The results are shown in Table 4, and the results show almost the same tendencies as in the case of TIG welding. Thus, sample A (AISI 430) has a low impact value in the weld zone, and the results of the tensile test also indicate that the weld zone of sample A is brittle and weak. In contrast, all of the steels according to the present invention show high toughness and also high strength in the weld zone.

TABLE 4

| Sample No. | Impact and Tensile Properties of Flash Butt-Weld Zone: Impact Value (kg-m/cm²) −20° C | 0° C | 20° C | 40° C | Tensile Properties: Tensile Strength (kg/mm²) | I.Elongation (%) | Rupture Position |
|---|---|---|---|---|---|---|---|
| A AISI 430 | 0.7 | 1.1 | 1.8 | 2.1 | 32.1 | 15.4 | Deposited Metal |
| E Present Invention | 10.1 | 12.3 | 15.7 | 16.5 | 44.3 | 30.7 | Base Metal |
| H " | 11.2 | 12.2 | 16.8 | 18.9 | 42.2 | 32.1 | " |
| I " | 7.4 | 10.2 | 13.7 | 15.1 | 49.6 | 28.7 | Weld Bond |
| J " | 11.0 | 13.4 | 16.1 | 17.7 | 49.2 | 29.2 | Base Metal |

EXAMPLE 3

Some typical grades of steels used in Example 1 were welded by flash butt welding and the impact property and tensile property of the weld zone were examined. For the flash butt welding, hot rolled steel sheets of 3.8 mm thickness were welded with a length of 50 mm, and the tensile test pieces were of 120 mm length. The welding was done under the following conditions.

Flash current: 3 KA, flash time: 30 seconds, flash voltage: 4.3 V, flash loss: 11 mm, upset pressure: 2.3 tons, upset loss: 18 mm, upset current: 10 KVA, and upset current passage time: 0.1 second.

EXAMPLE 4

Steels having compositions shown in Table 5 were prepared in a 60T convertor, subjected to Reinhold degassing treatment, made into slabs or billets by continuous casting or an ordinary ingot making method, and then hot rolled into sheets of 3.2 mm thickness.

Some of the hot rolled steel sheets thus obtained were cold rolled by a single reduction cold rolling process (1 CR) and others were cold rolled by a double reduction cold rolling process (2 CR) to obtain cold rolled steel sheets. Comparisons were made concerning the ridging property and workability of these cold rolled steel sheets. The results are shown in Table 6

TABLE 5

| | C | Si | Mn | P | S | Ni | Cr | Al | Ti | N |
|---|---|---|---|---|---|---|---|---|---|---|
| Steel of Present Invention | 0.008 | 0.18 | 1.4 | 0.029 | 0.005 | — | 16.5 | 0.013 | 0.22* | 0.0097 |
| Steel corresponding to AISI 430 | 0.07 | 0.53 | 0.47 | 0.032 | 0.007 | 0.6 | 16.3 | — | — | 0.017 |

*Effective Ti: 0.15

TABLE 6

| | Mechanical Properties: $\sigma_{0.2}$ (kg/mm²) | $\sigma_B$ (kg/mm²) | t.El (%) | u.El (%) | Controlling Factors of Workability: n | $\bar{r}$ | Δr | Er (m/m) | CCV (m/m) | Ridging Properties | Remarks |
|---|---|---|---|---|---|---|---|---|---|---|---|
| Steel of Present Invention 2CR | 26.4 | 43.7 | 35.6 | 20.0 | 0.270 | 1.64 | 0.95 | 9.8 | 27.3 | A | L direction (LDR >2.09) |
| Steel corresponding to AISI 430 2CR | 35.0 | 48.6 | 31.4 | 18.7 | 0.253 | 1.39 | 1.44 | 9.4 | 28.5 | B | L direction (LDR 2.03) |
| Steel of Present Invention 1CR | 26.2 | 43.5 | 33.9 | 19.3 | 0.261 | 1.41 | 0.81 | 10.3 | 46.8 | B | L direction |
| Steel corresponding to AISI | 34.3 | 49.1 | 31.5 | 18.8 | 0.244 | 1.14 | 1.11 | 10.2 | 48.0 | B | L direction |

TABLE 6-continued

| | Mechanical Properties | | | | Controlling Factors of Workability | | | | | Ridging | |
|---|---|---|---|---|---|---|---|---|---|---|---|
| | $\sigma_{0.2}$ (kg/mm²) | $\sigma_B$ (kg/mm²) | t.El (%) | u.El (%) | n | $\bar{r}$ | Δr | Er (m/m) | CCV (m/m) | Properties | Remarks |
| 430CR | | | | | | | | | | | |

Notes
(1) 2CR:
Annealing of hot rolled steel sheet
(800° C × 8 hours: 3.2 mm thick) →
primary cold rolling (1.5 mm thick) →
primary annealing *820° C × 10 minutes) →
secondary cold rolling (0.7 mm thick) →
finishing annealing (820° C × 10 minutes).
(2) 1CR:
Annealing of hot rolled steel sheet
(800° C × 8 hours: 3.2 mm thick) →
cold rolling (1.0 mm thick) →
annealing (820° C × 10 minutes).
(3) LDR:
Blank size: 61 - 69 mm
Punch size: 33 mm diameter
(4) Ridging Property:
A : Ridging less than 20μ
B : Ridging between 20 and 30μ

As understood from the results shown in Tables 5 and 6, the cold rolled steel sheet of the composition according to the present invention obtained by the 2CR process shows a very high $\bar{r}$ value of more than 1.5 as compared with cold rolled steel sheets obtained by the ICR process of AISI 430, even when compared with cold rolled steel sheets obtained by the 1CR of the present invention. Thus, it is understood that the double reduced cold rolled steel sheet of the present invention gives very excellent workability and the highest level (A) of the ridging property, in addition to the excellent toughness of the weld zone.

The steel compositions according to the present invention are produced by an ordinary steel making process, such as, by a convertor, an electric furnace and a vacuum melting furnace, and they may be produced by an ordinary ingot-making method and a continuous casting process as well.

As described above, the steels according to the present invention can be produced at low cost, and yet give good workability and weldability in addition to excellent toughness in the base metal and the weld zone. Therefore, the steels of the present invention are very suitable for various applications where forming is required, such as, electric house appliances, cooking utensiles, bathtubs, automobile parts including exhaust pipes, molds, etc., and bicycle parts including rims, handles, etc. Further, the steel grades containing 19% or more of Cr according to the present invention show very good oxidation resistance at elevated temperatures in addition to their good workability and weldability, and they are suitable for wide applications, such as, for cleaning devices of automobile exhaust gases.

Thus, the present invention provides remarkable industrial and economical advantages.

What is claimed is:

1. A stainless steel having a substantially ferritic structure consisting essentially of $C \leqq 0.05\%$ $Si \leqq 0.7\%$ $1.0\% < Mn < 2.5\%$ $Cr = 10\%$ to $19\%$ $Ti = 5 \times C\%$ to $0.5\%$ $N \leqq 0.03\%$ Al = from a residue left after deoxidation to 0.5% and $0.05 \leqq$ the amount of effective Ti $\leqq 0.2$ where the amount of effective Ti = Total Ti − (4×C% + 24/7×N%) the balance being Fe and unavoidable impurities, and wherein $Cr_{23}C_6$ precipitate is and wherein $Cr_{23}C_6$ precipitate is present in the grain boundary and has an average length of not more than about two microns and said steel, when welded, having a workability in the range from equal to or greater than about 6 mm in Erichsen value in both the base metal and weld zone and a low temperature toughness equal to or greater than about 5 kg/cm² at −20° C in both the base metal and the weld zone.

2. The steel of claim 1 which, when welded has Erichsen value of equal to or greater than 10.0 mm and 6 mm in the base metal and weld zone, respectively, and low temperature toughness equal to or greater than 6 kg/cm² and 5 kg/cm², in the base metal and weld zone, respectively.

3. A stainless steel having a substantially ferritic structure consisting essentially of $C \leqq 0.05\%$ $Si \leqq 0.7\%$ $1.0\% < Mn < 2.5\%$ $Cr = 10\%$ to $19\%$ $Ti = 5 \times C\%$ to $0.5\%$ $Ti + Nb = 5 \times C\%$ to $0.6\%$ $N \leqq 0.03\%$ Al = from a residue left after deoxidation to 0.5% and $0.05 \leqq$ the amount of effective Ti $\leqq 0.2$ where the amount of effective Ti = Total Ti − (4×C% + 24/7×N%), the balance being Fe and unavoidable impurities, and wherein $Cr_{23}C_6$ precipitate is present in the grain boundary and has an average length of not more than about two microns and said steel, when welded, having a workability in the range from equal to or greater than about 6 mm in Erichsen value in both the base metal and weld zone and a low temperature toughness equal to or greater than about 5 kg/cm$^2$ at $-20°$ C in both the base metal and the weld zone.

4. The steel of claim 3 which, when welded has Erichsen value of equal to or greater than 10.0 mm and 6 mm in the base metal and weld zone, respectively, and low temperature toughness equal to or greater than 6/kg/cm$^2$ and 5 kg/cm$^2$, in the base metal and weld zone, respectively.

* * * * *